US005099725A

United States Patent [19]

Bouligny, Jr. et al.

[11] Patent Number: 5,099,725

[45] Date of Patent: Mar. 31, 1992

[54] TORQUE TRANSFER APPARATUS

[75] Inventors: Vernon J. Bouligny, Jr., New Iberia; Mark S. Sibille, Lafayette, both of La.

[73] Assignee: Franks Casing Crew and Rental Tools, Inc., Lafayette, La.

[21] Appl. No.: 600,533

[22] Filed: Oct. 19, 1990

[51] Int. Cl.[5] ..... B25b 13/50

[52] U.S. Cl. ..... 81/57.34; 81/57.35

[58] Field of Search ..... 81/57.4, 57.34, 57.35, 81/57.16, 57.33

[56] References Cited

U.S. PATENT DOCUMENTS

| | | | |
|---|---|---|---|
| 3,545,313 | 12/1970 | Kelley | 81/57.34 |
| 4,091,451 | 5/1978 | Weiner et al. | 364/506 |
| 4,125,040 | 11/1978 | True | 81/429 |
| 4,170,908 | 10/1979 | Peveto et al. | 81/57.11 |
| 4,290,304 | 9/1981 | Eckel | 81/57.18 |
| 4,346,629 | 8/1982 | Kinzbach | 81/57.2 |
| 4,402,239 | 9/1983 | Mooney | 81/57.16 |
| 4,492,134 | 1/1985 | Reinhoidt et al. | 81/57 |
| 4,494,425 | 1/1985 | Shewmake, Sr. | 81/57.34 |
| 4,753,108 | 6/1988 | Jansch | 73/49.8 |
| 4,838,073 | 6/1989 | Jansch | 73/40.7 |
| 4,843,702 | 7/1989 | Charest | 29/240 |
| 4,876,884 | 10/1989 | Jansch | 73/49.1 |
| 4,972,741 | 11/1990 | Sibille | 81/57.34 X |

OTHER PUBLICATIONS

Weatherford Brochure, two pages, "Dual Completion Tong", Apr. 1990.

*Primary Examiner*—D. S. Meislin
*Attorney, Agent, or Firm*—Matthews and Associates

[57] ABSTRACT

An apparatus for making up or breaking out of two members having mating threaded connections, such as pipe joints or bolts for avoiding undesirable transverse forces relative to the two members during tightening (or loosening), thereby insuring the connection is made up (or broken out) by essentially pure torque loads.

The apparatus includes a power-driven lead tong, a back-up tong, a load cell which cooperates with either tong to produce a torque measurement and an interconnecting frame and isolation apparatus which eliminates transverse forces relative to the two threaded members. The power-driven lead tong rotatingly drives the first threaded member about its axis either clockwise or counterclockwise, as required. The back-up tong secures the second threaded member against axial rotation in response to the rotation of the first member. The interconnecting frame and isolation apparatus adapts the lead tong to the back-up tong in such a manner that their relative tendencies to rotate about the threaded members, in opposite directions, counteract each other. Also, by means of interconnecting members and isolation apparatus allowing relative movement along x, y and z axis between the lead tong and the back-up tong, but which does not allow relative rotation about the z axis, the interconnecting frame prevents undesirable transverse forces from occurring, between the lead tong and the back-up tong in response to the driving torque of the lead tong. Further, by means of said interconnecting members and isolation apparatus, the interconnecting means eliminates transverse forces which would otherwise develop because of irregularities of the threaded members (such as bent members or eccentric lead). A load cell cooperating with the isolation apparatus, internally disposed in the interconnecting frame, cooperates between the isolation apparatus and the tong housing to produce a torque measurement without inducing transverse forces on the threaded members.

6 Claims, 10 Drawing Sheets

TORQUE TRANSFER APPARATUS

This invention is related to U.S. Pat. No. 4,972,741 issued Nov. 27, 1990 to Sibille, Et Al.

BACKGROUND OF THE INVENTION

1. Field of the Invention

The invention relates to apparatus used for assembling or disassembling members having mating threaded connections, such as pipe joints, threaded rods and bolts. More particularly, the invention relates to improved means to interconnect power-driven lead tong and back-up tongs, commonly used to make-up and break-out tubular goods used in earth boreholes, particularly in oil and gas wells. Additionally the invention relates to improved means to measure the torque applied to a threaded member by said tong combination.

2. Description of Prior Art

In virtually every industrial field there is at least some requirement for assembling and disassembling members having mating threaded connections such as, pipe, rods and bolts. Perhaps the best known requirement for making-up (or breaking-out) of such members exists in the earth boring industry, particularly that involving exploration for, and production of, oil and gas wells. In the oil and gas field, depending on the phase of operations being conducted, miles of drill pipe, hole casing or production tubing are necessarily assembled at the surface on a piece-by-piece basis. Similarly, each time it becomes necessary to remove pipe, casing or tubing from the borehole (for bit changes, pipe repair, pipe salvage or many other reasons), the string of pipe is progressively lifted from the hole, and disassembled at the surface on a piece-by-piece basis.

Because of the need to repetively make and break threaded member connections, various apparatus, generally referred to as tongs, more specifically lead tongs and back-up tongs, have been developed to facilitate that task.

As deeper wells are drilled the weight of the pipe string increases, as does the internal and external pressures the pipe must bear, thus greater demands are placed on the pipe, particularly on its threaded connections. In deeper wells pipe joints are often tightened to a high, extremely critical torque. Too low a torque can lead to leakage of drilling fluids or even the flammable fluids being produced. Too high a torque can damage the pipe joints and result in leakage or even separation of the pipe string in the hole. It is readily apparent that replacement or repair of damaged pipe, sometimes not discovered until the pipe is set in the borehole, is time consuming, dangerous and expensive.

It is readily apparent that during assembly and disassembly of a threaded connection there is no requirement for transverse (or lateral) (normal to the pipe axis) forces to be applied to said connection and, in fact such forces can have serious detrimental effects. Frictional forces due to lateral forces cause false torque reading and can cause premature thread galling. Said lateral forces can actually bend the pipe. Application of lateral forces during tightening can also cause the connection to tighten off center, which can result in loss of the connection's fluid seal.

While much of the prior art addresses other problems regarding use of tongs to assemble and disassemble threaded connections, the problem of lateral stresses has, hitherto, not been solved.

KELLEY, U.S. Pat. No. 3,545,313, Dec. 8, 1970, discloses a combined lead tong("grapple") and back-up tong. The lead tong and back-up tong are movable relative to each other along the axis of the pipe and the back-up tong is slidable toward and away from that axis. Relative turning movement of either the lead tong or the back-up tong is prevented by use of a single, interconnecting, rearwardly disposed shaft and sleeve arrangement. As is readily apparent this means of interconnection induces lateral forces on pipe joint during tightening or loosening. No means is disclosed for measuring the torque these tongs apply to the: pipe joint.

WEINER, U.S. Pat. No. 4,091,451, May 23, 1978, disclosed a method and apparatus for calculating the torque being applied to a pipe joint and for counting the number of turns of one member relative to the other. The invention discloses, in essence, a means for early detection of a "bad joint" being caused by lateral forces being applied during tightening, which causes "bending of one of the threaded members relative to the other, such as when rotating pipe sways, creates a false indication of reference torque . . . ". This invention detects some of the problems caused by the application of lateral forces during tightening or loosening, but does not prevent the lateral forces from occurring.

TRUE, U.S. Pat. No. 4,125,040 discloses an apparatus for automatically stopping the application of torque to a pipe joint when a predetermined value has been achieved. The sensing means described is a strain gauge in a snubbing line. With reference to FIG. 1(*a*) herein, as is readily apparent, use of a snubbing line to restrain tong rotation about the pipe induces lateral stresses on the pipe joint during tightening or loosening.

PEVETO, U.S. Pat. No. 4,170,908, Oct. 16, 1979, discloses a combined lead tong and back-up tong which is improved by the addition of an automatic indexing mechanism which aligns openings of the frame after make-up or break-put of a pipe joint. Also, disclosed is a pair of fasteners disposed on each side of the tong for purpose of suspending the back-up tong from the lead tong. Though not discussed, it appears that the fasteners are somewhat slidable in the direction of the pipe axis and toward and away from the pipe axis. No third slide, perpendicular to the slide allowing movement toward and away from the pipe axis, is provided. Without such slide lateral forces would be imposed on the pipe connection during tightening or loosening.

ECKEL, U.S. Pat. No. 4,290,304, Sept. 22, 1981, discloses a back-up tong improved by the addition of an apparatus which automatically releases the back-up tong if the drill pipe begins to slip down into the borehole or the tongs are lifted prematurely. Disclosed therein is a "stinger" rearwardly disposed on the back-up tong frame which cooperates with a load cell and the lead tong to produce a torque measurement. With reference to FIG. 1 and FIG. 2, said stinger, either cooperating with a snubbing line or with a "reaction bar" attached to the lead tong, would induce lateral stresses on the pipe during tightening or loosening.

KINZBACK, U.S. Pat. No. 4,346,629, Aug. 31, 1982, discloses a lead tong for use in making-up and breaking-out of joints of varying diameter. No specific means of restraining tong movement about the pipe or measuring torque is disclosed.

MOONEY, U.S. Pat. No. 4,402,239 discloses a combined lead tong and back-up tong which rearwardly cooperate with a load cell to produce a torque measurement. The back-up tong is suspended from the lead tong by a plurality of vertical shafts which cooperate with elongated apertures through the back-up tong to allow some relative rotational movement between the tongs. The disclosed means of interconnecting the tongs does not prevent lateral forces on the pipe joint, in fact the rearwardly disposed rigid cooperation between the lead tong and back-up tong (through a load cell) induces lateral forces on the pipe joint during tightening or loosening.

REINHOLDT, U.S. Pat. No. 4,492,134, Jan. 8, 1985, discloses a combined lead tong and back-up tong slidably mounted to a platform. The lead tong and back-up are interconnected by a plurality of hydraulic cylinders each of which is movable in any direction in a horizontal plane, rotatably or linearly, against "resilient" support elements. This invention does not prevent lateral forces from being applied to the pipe joint during tightening or loosening, but attempts to "compensate" for "traverse relative movements, which cannot be completely prevented".

SHEWMAKE, U.S. Pat. No. 4,494,425, Jan. 22, 1985, discloses combined spinning tong and back-up tong having a slidable interconnection between the tongs, along the pipe axis, to allow the distance between the tongs to shorten or lengthen as the pipe joint shortens during assembly or lengthens during disassembly. The disclosed means of interconnection, comprising no traverse slides, does not prevent lateral forces on the pipe joint during tightening or loosening.

None of these patents disclose the present invention. In each of these patents the means used to "hold" the tongs "in place", that is, restrain them from rotating about the pipe axis during tightening or loosening, whether by snubbing lines or by the interconnecting means disclosed, produce lateral forces on the pipe joint during said torquing process. Some of the patents disclose means of detecting the undesirable effect of lateral forces and some attempt to "compensate" for some of the undesirable effects of lateral forces, but none are directed to preventing those forces from arising.

When a lead tong is operated, a rotary element contained within the tong body grasps a first threaded member. A motor, usually hydraulic, contained within the lead tong body generates a "driving torque" which is applied to the rotary element to rotate it, and the first threaded member therein, in the desired direction. By operation of Newton's third law of physics (that is, in essence, "for every force there exists an equal and opposite force"), creation of the "driving torque" (which is applied to the threaded member) results in a "reacting torque", which is applied to the lead tong body in the opposite direction. This reaction torque must be counteracted, to secure the lead tong body from spinning about the pipe rather than driving the pipe itself.

Hitherto, prior art means for securing the lead tong body against rotation about the pipe were by use of a snubbing line, a "reaction bracket" which rigidly cooperates with back-up tongs, or multiple members which rigidly (or resiliently) cooperate with the back-up tongs. All of these conventional means produce linear, laterally directed and unpaired force vectors on the lead tong body. The lead tong body tends to move laterally in response to said linear force vectors, which said lateral movement is resisted by the pipe. FIG. 1(*a*) diagrams the lateral force vectors when a prior art snubbing line was used to secure the lead tong body against movement about the pipe. FIG. 1(*b*) diagrams the lateral force vectors when a prior art "reaction bracket", cooperating with the back-up tong. was used to secure the lead tong body against movement about the pipe. FIG. 1(*c*) diagrams the prior art lateral force vectors when a prior art multiple rigid interconnects, cooperating with the back-up tong. was used to secure the lead tong body against movement about the pipe.

With reference to prior art back-up tongs, a similar phenomena occurred. Means used hitherto to secure back-up tongs from rotating with the pipe resulted in lateral force being applied to the second threaded member (lower pipe). The lateral force vector applied to the second threaded member (lower pipe) was equal in magnitude, but opposite in direction to the lateral force induced by the lead tong above. A combination of the lateral force imposed on the upper pipe by the lead tong and on the lower pipe by the back-up tongs produced a bending moment across the pipe joint being tightened or loosened. FIG. 2(*a*) diagrams the lateral force vectors, created by both the lead tong and the back-up tong, when prior art snubbing lines were used. FIG. 2(*b*) diagrams the lateral force vectors created by both the lead tong and the back-up tong when a prior art "reaction bracket" was used. FIG. 2 (*c*) diagrams the lateral force vector created by both the lead tong and back-up tong, when prior art multiple rigid (or resilient) interconnects were used.

As is readily apparent, the application of lateral forces on a pipe joint during tightening or loosening can have serious undesirable effects. Extra, and uneven, friction forces (see FIG. 3) caused by such side-loading can cause premature galling of the threads. The extra frictional forces can cause a false measurement which results on the joint being inadequately tightened. Further, the joint could "freeze" with a lateral displacement of the threads, which causes poor fluid sealing, or, if the lateral displacement later resolves, the joint may then be inadequately tightened.

The invention disclosed herein represents a vast improvement over prior art.

OBJECTS OF THE INVENTION

The general objects of this invention are to provide a new and improved tong apparatus for assembling and disassembling tubular goods (or solid cylindrical goods) having threaded connections.

More particularly, one object of the present invention is to interconnect the lead tongs and back-up tong so that their relative tendencies to rotate about the pipe axis, in opposite directions, counteract each other and therefore the combined, interconnected unit does not require external securing means such as snubbing lines.

Another object of the present invention is to provide a means of tong interconnection which does not induce lateral forces on the pipe joint during torque application (tightening or loosening).

A further objected of the present invention is to provide a means of tong interconnection which eliminates lateral forces which might otherwise occur because of irregularities of the threaded members, such as, bent pipe or eccentric lead.

Yet another object of the present invention is to provide a means of tong interconnection which allows the distance between the tong bodies to shorten or lengthen during tightening, to accommodate the pipe joint becoming shorter as threads are taken up (or becoming longer as the pipe joint loosens).

Yet another object of the invention is to provide a means by which the torque being applied to the pipe joint can be directly and accurately measured.

SUMMARY OF THE INVENTION

The improved combined tong apparatus for assembling and disassembling members having mating threaded connections, according to the present invention, is characterized by a lead tong, a backup tong, and a means for interconnecting the lead tong to the back-up tong in such a manner that no single, unpaired forces, but rather only "couples" (paired forces of equal magnitude, but opposite direction) are created by the interconnecting means; and, a load cell which cooperates, in either tong, between a pivoting, internal moment arm and the tong housing to produce a torque measurement.

When the lead tong is operated, its driving torque tends to cause the lead tongs to rotate about the threaded member in the direction opposite to the driving torque. Since the back-up tong firmly grasps one of the threaded members, said driving torque also tends to cause the back-up tong to rotate in the same direction as the driving torque. By interconnecting the lead tong body to the back-up tong body, each tong's relative tendency to rotate about the threaded member. Therefore, the assembly does not require extraneous means for securing it in place, such as snubbing lines.

The back-up tongs are adapted to the lead tongs by means of an interconnecting structure, torsionally rigid, but which allows three dimensional linear movement between the tongs. By being torsionally rigid, but slidable linearly, in the directions indicated, the interconnecting frame is therefore not capable (within all normal operating limits) of transferring any net lateral force vectors between the two tong bodies, but rather resolves all such force vectors to "couples" external to the threaded member. By using only "couples" (the equivalent of "pure torque") to secure each tong from rotation about the pipe axis, there is no tendency for tongs to impose lateral forces on the pipe during tightening (or loosening).

Either tong is equipped with a pivoting torque arm which cooperates with the tong housing and a load cell to produce a torque measurement.

A second embodiment of the invention provides a variant interconnecting structure, which is torsionally rigid but allows freedom of movement, relative linear movement, between the tongs in three directions, one being concentric with the axis of the cylindrical body or members the tongs are adapted to be utilized with, and the other two directions being perpendicular both to each other and the axis of the concentric body. Instead of providing the x-slide, y-slide and z-slide as in the first embodiment, this second embodiment utilizes a connection which permits both sliding and pivoting of the previous z-slide connection, and this second embodiment replaces the x and y-slides with a pivot arm linkage and floating suspension system which is so connected and arranged as to permit relative movement between the tongs in the x and y directions, and to provide a means for torque reading measurements. The improved second embodiment provides more accurate torque readings due to less frictional losses, is simpler and less expensive to fabricate is smaller and lighter, more adaptable to various gripping mechanisms, and more durable and thus easier to handle and use.

BRIEF DESCRIPTION OF THE DRAWINGS

FIG. 2(*b*) is a schematical isometric view of PRIOR ART combined tongs which use a single "reaction bracket" to restrain tong movement.

FIG. 2(*c*) is a schematical isometric view of PRIOR ART which uses a plurality of rigid interconnecting shafts to interconnect the lead tong and back-up tong.

DESCRIPTION OF THE PREFERRED EMBODIMENT

The present invention has three major components; a power-driven lead tong, an improved means for interconnecting a lead tong, and, a back-up tong. Either the lead tong or the back-up tong has improvements to allow for measurement of torque.

The first major component of the combined tong apparatus is a power-driven lead tong. The lead tong contains elements for gripping and rotating a first threaded member (upper pipe) in threadable alignment with a second threaded member (lower pipe).

The preferred embodiment of the present invention has power-driven lead tongs of the sort ordinarily used in the oilfield, such as those disclosed in U.S. Pat. No. 4,060,014.

The second major component of the present invention is an improved means for connecting a lead tong to a back-up tong.

Figure 1C:
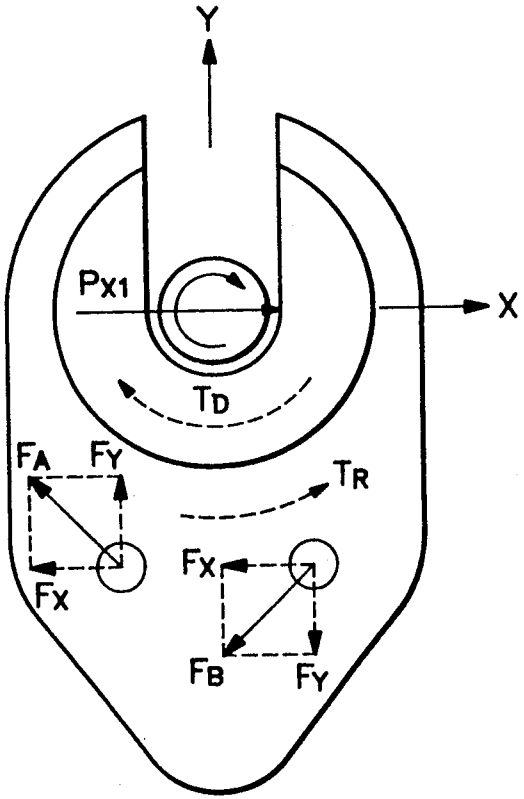
FIG. 1C (PRIOR ART)
FIGS. 1(*a*), 1(*b*) and 1(*c*) are schematical overhead views of PRIOR ART lead tong illustrating force vectors during tightening; 1(*a*) showing the effect of a snubbing line; 1(*b*) showing the effect of a reaction bracket;. and, 1(*c*) showing the effect of multiple rigid interconnects.
Figure 1B:
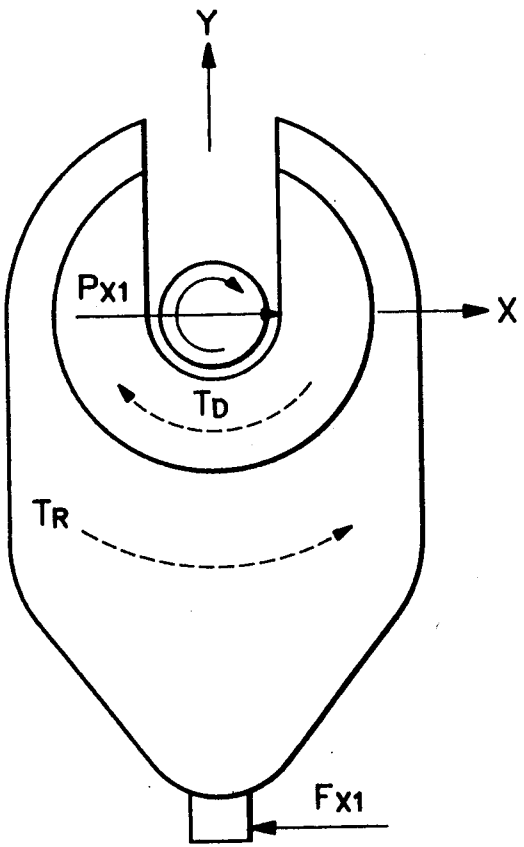
FIG. 1B (PRIOR ART)
Figure 1A:
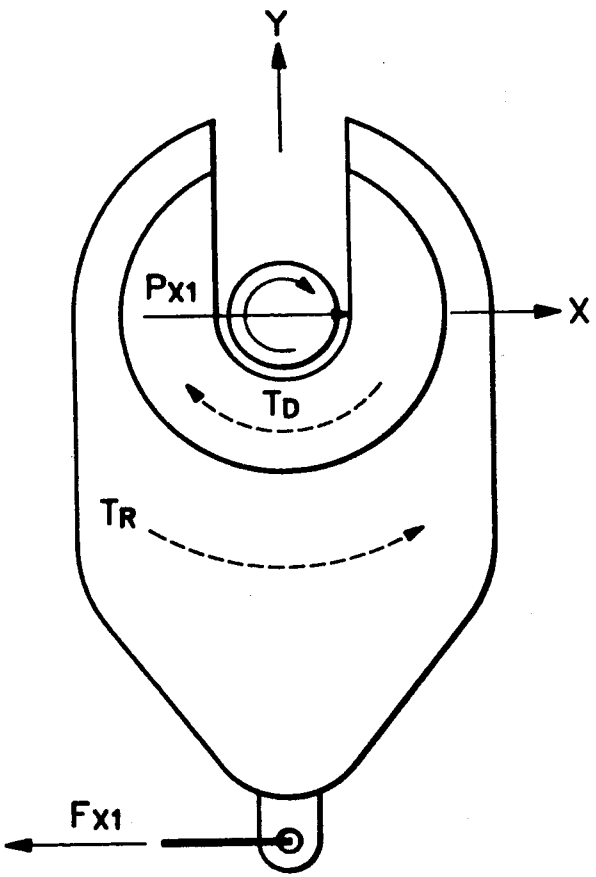
FIG. 1A (PRIOR ART)

With reference to FIG. 1(*a*), showing prior art, it is seen that when a lead tong is operated it produced a driving torque, $T_D$, which acts on a rotary element which is grippingly engaged to a first threaded member (upper pipe). In response to the driving torque, $T_D$, a reaction torque, $T_R$, is imposed on the tong body in the direction opposite to that of pipe rotation. The lead tong must be secured against rotation about the pipe axis, in response to $T_R$, otherwise the tong would simply rotate about the pipe rather than rotating the pipe itself.

With reference to FIGS. 1(*a*), 1(*b*) and 1(*c*), showing prior art, it is seen that conventional means for securing a lead tong against rotation in response to $T_R$, whether by a snubbing line (FIG. 1(*a*)), reaction bracket (FIG. 1(*b*)) or multiple rigid interconnects to the back-up tong (FIG. 1(*c*)) all involve lateral, linear forces, $F_x$, being imposed on the tong housing. In response to $F_x$, the tong housing tends to move laterally. Said lateral movement of the tong causes deflection of the pipe, which gives rise to Px, which then counteracts $F_x$. Therefore, while both rotational and linear equilibrium of the tongs was achieved by prior art means, it was at the expense of lateral deflection of the pipe. As driving torque, $T_D$, increases; the reaction torque, $T_R$, also increases; as does the force required to secure the tong against rotation, Fx; and as does the force, $P_x$, which is developed by the pipe in response to lateral deflection.

Figure 2B:
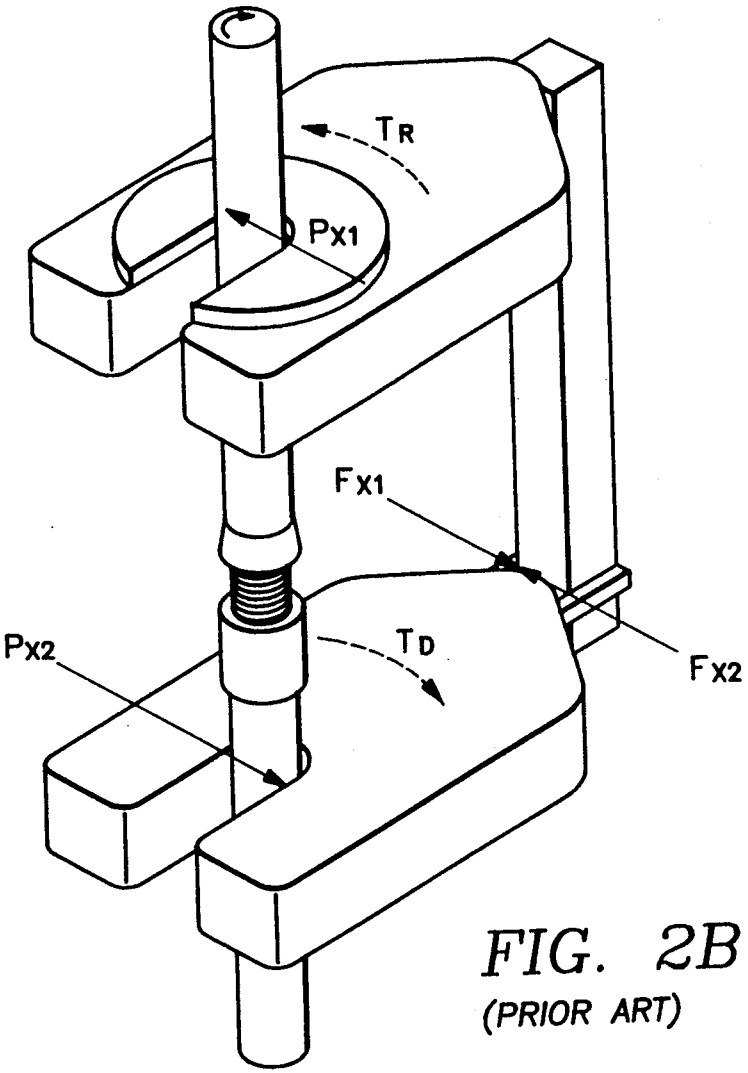
FIG. 2B (PRIOR ART)
FIG. 2(*a*) is a schematical isometric view of PRIOR ART combined tongs which use snubbing lines to restrain tong movement.
Figure 2A:
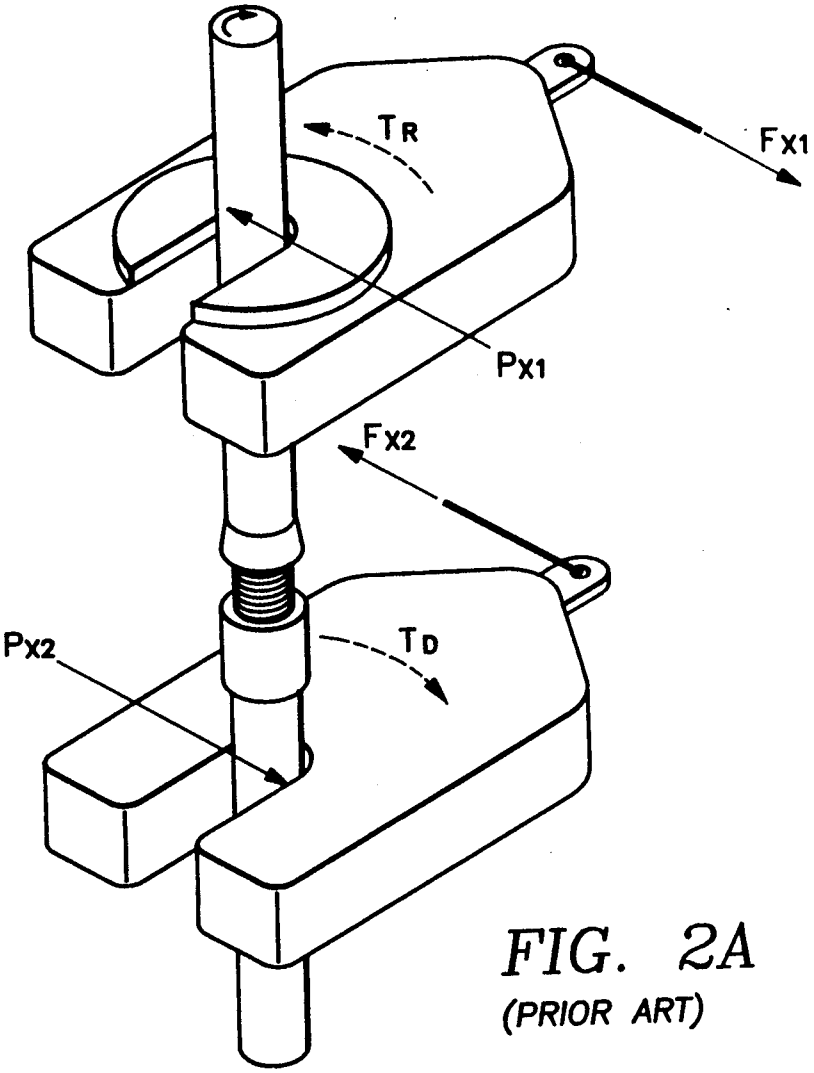
FIG. 2A (PRIOR ART)
Figure 3:
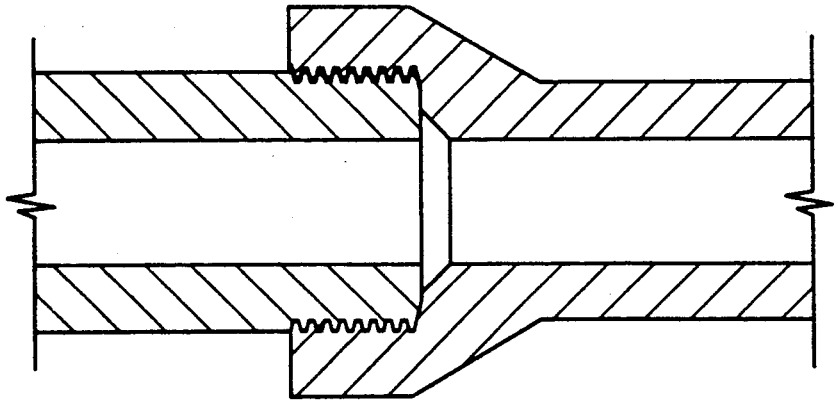
FIG. 3 is a schematical sectional view of a threaded member connection being tightened while under the influence of lateral forces.
Figure 2C:
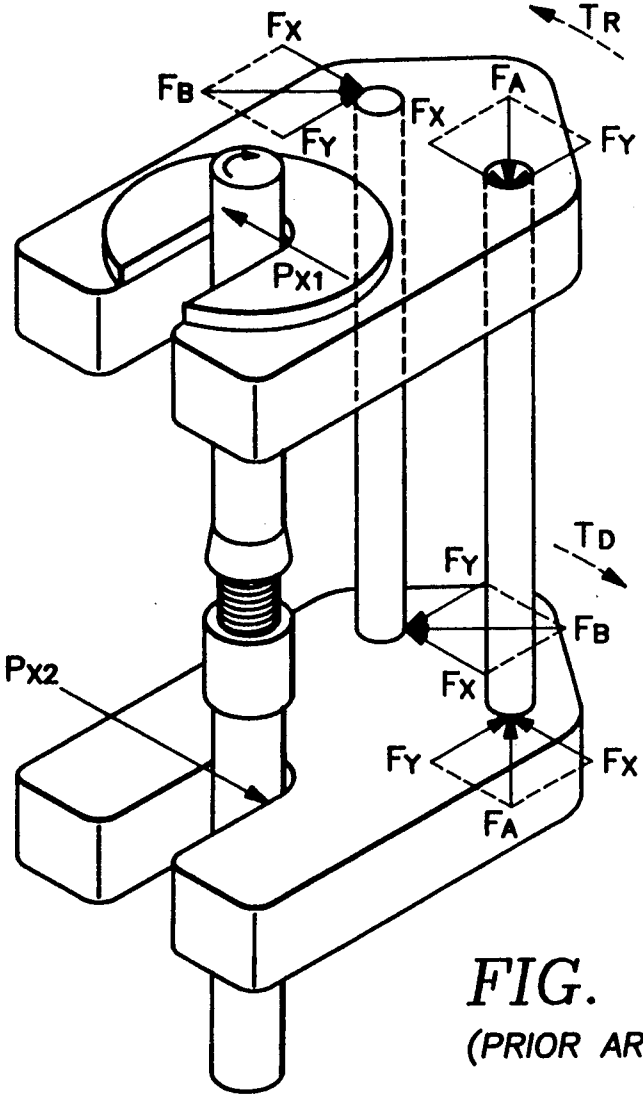
FIG. 2C (PRIOR ART)

With reference to FIGS. 2(*a*), 2(*b*) and 2(*c*), showing prior art, it is seen that a similar (but opposite direction) reaction occurs at the level of the back-up tong. The driving torque of the lead tongs, $T_D$, is transferred through the threaded members to the back-up tong which is grippingly engaged to the second threaded member (lower pipe). The back-up tongs therefore tend to rotate with the second threaded member, instead of securing the second member against rotation, unless the back-up tongs are restrained against rotary movement. One prior art means to secure a back-up tong against rotation involves use of rearwardly attached snubbing line (FIG. 2(*a*)). Other prior art means to secure a back-up tong against rotation involves use of a reaction bar (FIG. 2(*b*)) or use of multiple rigid interconnects (FIG. 2(*c*)). Said prior art means imposed linear, lateral forces, Fx, on the back-up tong body, which caused lateral deflection of the pipe, which gave rise to $P_x$. While rotational and linear equilibrium of the tack-up tongs was achieved, again, same was achieved at the expense of lateral deflection of the pipe.

The improved interconnecting means disclosed herein eliminates the necessity of snubbing lines by making use of each tong's tendency to rotate about the pipe axis, in opposite directions, to counteract each other. The improved interconnecting means, however, avoids the imposition of any net lateral forces on the tong housing, thereby avoiding the imposition of lateral forces on the threaded members.

In the preferred original embodiment of the present invention the interconnecting structure between the lead tong and the back-up tong is comprised of three pairs of slides interconnected in the series, each pair permitting relative movement between the lead tong and back-up tong in a certain linear direction. By connecting each pair of slides in a mutually perpendicular relationship to the other slides, an isolated torsional-transfer "joint" (a joint which will allow relative, three dimensional linear movement, but no relative rotary or angular movement) interconnects the lead tong and back-up tong. By permitting linear movement& between the two tongs, in any direction, the transferral of linear forces between the two tongs is eliminated, because in order for a "force" to arise "movement" must be resisted by an equal and opposite force. However, since the isolated-torsional transfer structure is torsionally rigid, each tong is restrained from axial rotation about the work piece by an equal torsional force created by the other tong. These torsional, pure torque and opposite, forces impose no lateral, bending or deflection loads on the work piece being made up or broken out. In the preferred embodiment we have chosen, as a matter convenience, to orient one pair of slides parallel to the pipe axis (called z-slide), one pair of slides parallel to a radial of the pipe extending through a point mid-way between this pair of slides (called y-slide), and the third pair of slides parallel to a line tangential to the pipe at the same mid-way point (called x-slide). Any other mutually perpendicular orientations could be selected so long as the physical structure of the ITT (isolated torsional transfer) joint does not interfere with operation of the tongs, and said joint is conveniently adaptable to the tong bodies.

The slide parallel to the pipe axis (callet z-slide) allows the distance between the tong bodies to increase or decrease as the pipe joint loosens or tightens. The z-slide also cooperates with the lateral slides (called x-slide and y-slide, respectively) to produce couples (paired forces of equal magnitude but opposite direction) to prevent relative rotational movement (torsional rigidity) between the tong housings.

The lateral slides permit relative linear movement in any direction in the lateral plane. The relative linear movement allowed prevents any net linear force from arising in the lateral plane (no force may arise unless something resists it). Conversely by virtue of the fact that each slide is connected to the adjacent structure (whether tong housing or adjacent slide) at more than one point, the lateral slides permit the transfer of paired forces (couples) between the tong housings, thereby providing torsional rigidity between said housings. By use of only couples (the equivalent of pure torque) to secure each tong against rotation about the threaded members, no lateral forces are imposed on the threaded member, and the connection is made by essentially pure torque.

While there may be many embodiments of the improved interconnecting means, with reference to FIG. 4 and FIG. 6, one embodiment is described below. Two cylindrical guides 1 are vertically adapted to the lead tong (FIG. 6) by means of adapting plates 2. Shafts 3 are slidably disposed within the cylindrical guides 2. The cylindrical guides 2 and shafts 3 slidably cooperate along the z-axis, and are called the z-slide. The lower part of shafts 3 slidingly cooperate (along the x-axis) with horizontal shafts 4. Horizontal shafts 4 are mounted to plate 5 by means of offset blocks 6, and are collectively called the x-slide. Plate 5 is adapted to tubes 7, which slidably cooperate (along the y-axis) with horizontal shafts 8 (called the y-slide). Horizontal shafts 8 are mounted to the back-up tong (not shown) by means of offset blocks 9.

Figure 4:
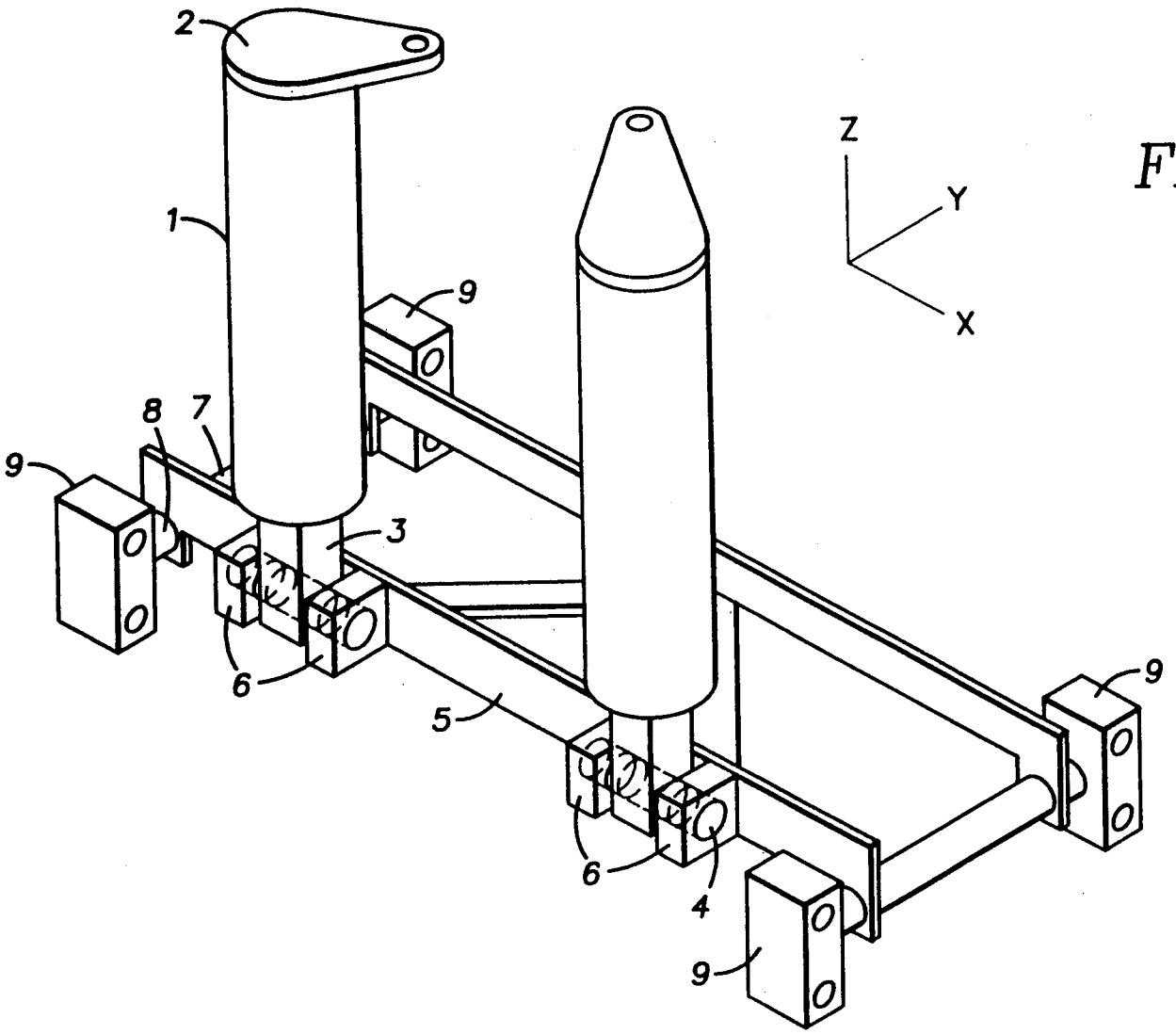
FIG. 4 is a isometric view of the interconnecting frame (without attached tongs) of the preferred embodiment of the present invention.
Figure 5:
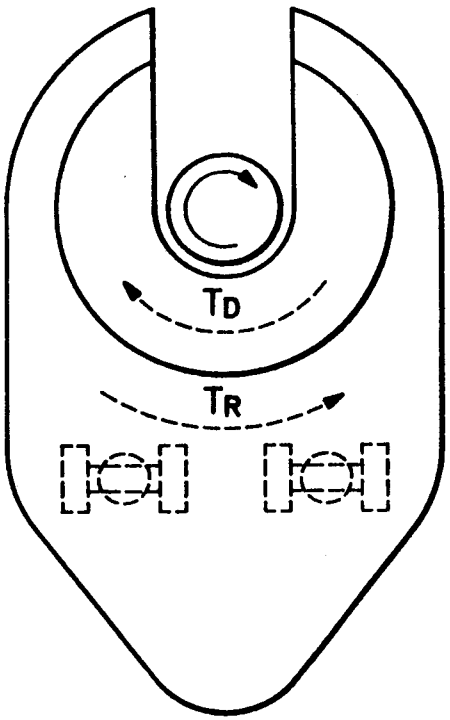
FIG. 5 is a schematical overhead view of the lead tongs of the present invention showing force vectors on the x-slide.

FIG. 5 is a schematical overhead view of the lead tong diagraming the force vectors imposed on the lead tong, by the x-slide of the aforesaid particular embodiment of FIG. 4. Since the tongs are slidable relative to each other in the x-direction, no relative forces may be transferred between the tongs in that direction. Reaction torque of the lead tongs, $T_R$, is counteracted by a couple whose component forces, $F_y$, are perpendicular to the x-slide.

Figure 6:
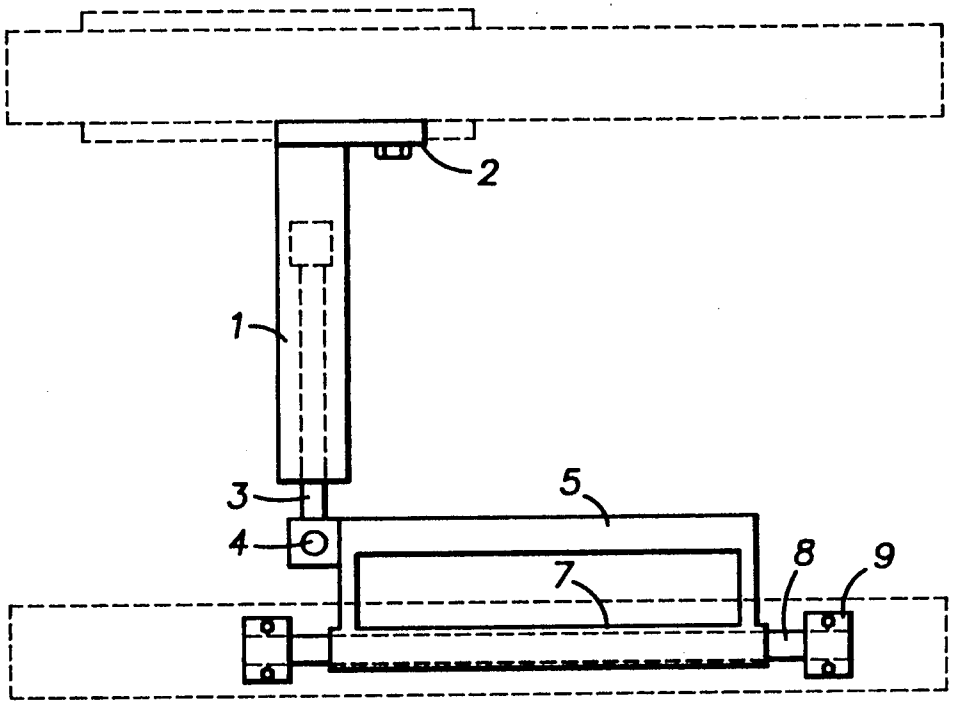
FIG. 6 is a side elevational view of the apparatus of FIG. 4.

FIG. 6 is a schematical side elevation view of the particular embodiment of FIG. 4, showing orientation of the x, y and z-slides.

Figure 7:
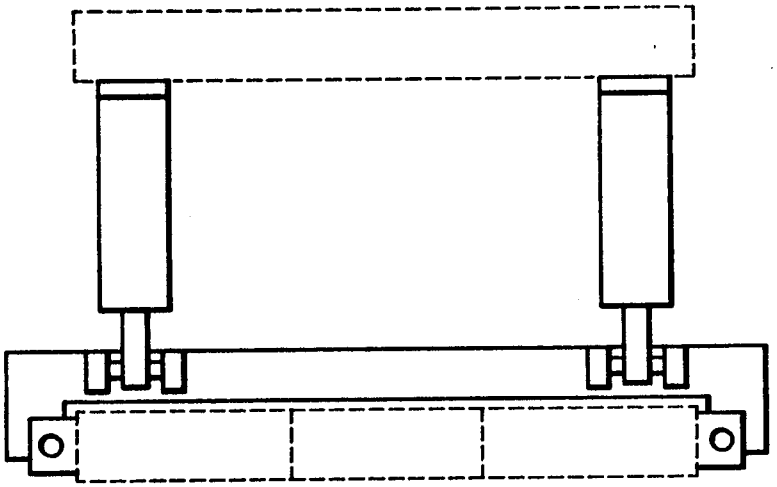
FIG. 7 is an end elevational view of the apparatus of FIG. 4.

FIG. 7 is a schematical front elevation view of the particular embodiment of FIG. 4, showing orientation of the x, y and z-slides.

Figure 8:
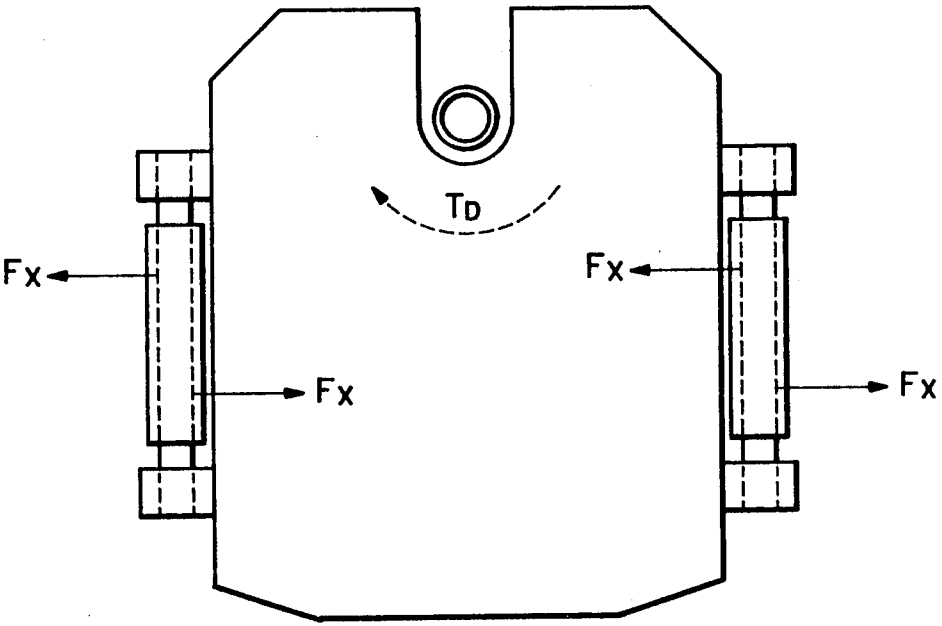
FIG. 8 is a schematical overhead view of the back-up tongs of the present invention, showing the force vectors on the y-slide.

FIG. 8 is a schematical overhead view of the back-up tongs diagraming the force vectors on the back-up tong, by the x-slide of the embodiment of FIG. 4. The driving torque, $T_D$, imposed on the back-up tong through the threaded members, is counteracted by paired forces, $F_x$, imposed on the y-slide perpendicularly.

Accordingly the driving torque, $T_D$ (imposed on the back-up tong) and the reaction torque, $T_R$ (imposed on the lead tong) are made to counteract each other through paired interconnected slides which provide torsional, but not linear rigidity. Consequently each tong is secured from rotating about the pipe by paired forces (couples) only, and, no lateral, linear forces exist between the tong housings. By eliminating unpaired lateral, linear forces between tong housings, no such forces are imposed on the pipe.

The third major component of the invention is a back-up tong. The back-up tong secures the second threaded member (lower pipe) from rotation in response to rotation of the first threaded member (upper pipe) threadably engaged therewith. An improved back-up tong is provided to allow a means, internal to the back-up tong, to produce a torque measurement. Prior art means for producing a torque measurement involved use of a load cell to measure the lateral forces imposed on one tong (for example, by use of a load cell in a snubbing line) or between the two tongs (for example, by use of a load cell cooperating with a reaction bracket). Because the improved interconnecting means eliminates all lateral forces, other means for producing a torque measurement are provided.

Figure 9:
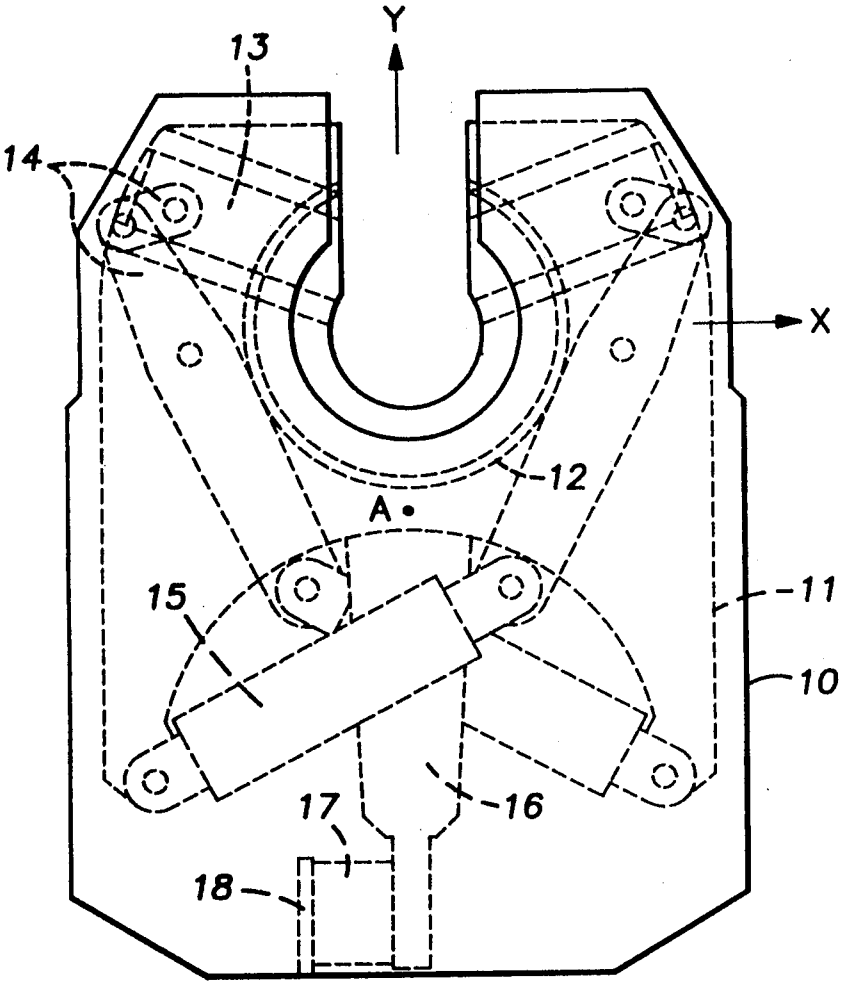
FIG. 9 is an overhead plan view of the back-up tong of the preferred embodiment of the present invention.

With reference to FIG. 9, the back-up tong of the preferred embodiment has an external housing 10, which pivotally cooperates with inner frame 11, through radial bearing 12. In the preferred embodiment radial bearing 12 is simply a circular groove and ridge arrangement which has its center coincident with the axis of the work piece. Alternatively, the external housing 10, can be made to pivotally cooperate with the inner frame 11 by any other conventional means, such as a pin and bushing arrangement, at any convenient point which is not coincident with the pipe axis, such as point A of FIG. 9. In the event a point not coincident with the pipe axis is chosen for pivotal engagement of the external housing 10, and inner frame 11, the load cell 17 will have a different calibration factor.

With further reference to FIG. 9, the gripping elements of the back-up tong; being dies 13, levers 14 and cylinders 15 are mounted to inner frame 11, and are the same as those found in conventional back-up tongs.

Further referring to FIG. 9, the preferred embodiment of the present invention has a moment arm 16, which is rigidly affixed to the inner frame 11 by conventional means. Rigidly affixed to the external housing 10 is plate 18. Load cell 17 cooperates between moment arm 16 and plate 18 to produce a torque reading.

Figure 10:
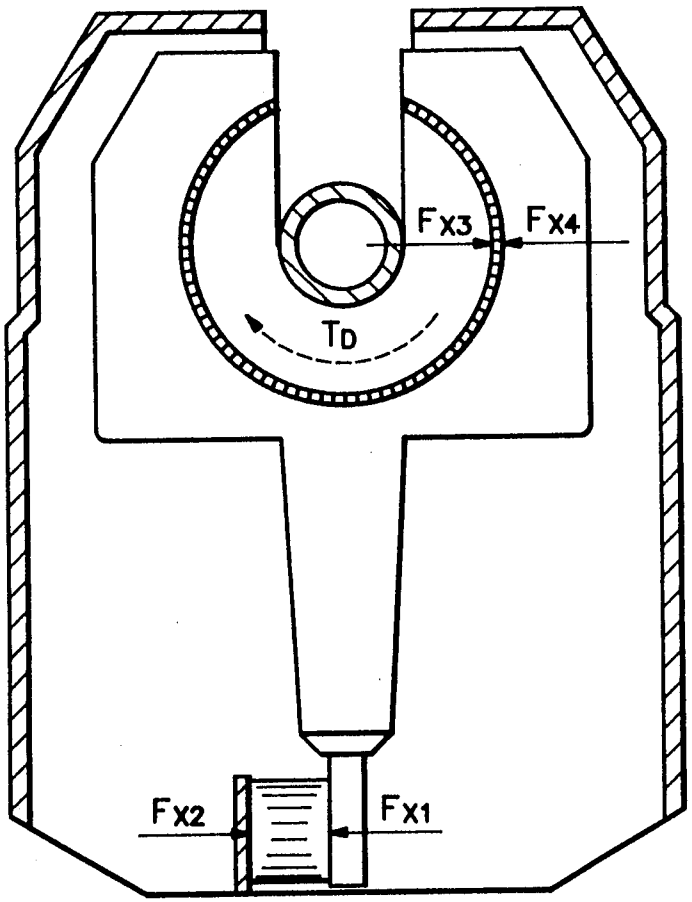
FIG. 10 is a schematical view of the back-up tong of the present invention, showing the force vectors on the radial bearing load cell and moment arm.

FIG. 10 is a schematical overhead view of the improved back-up tong of the present invention for purpose of illustrating the force vectors created in the back-up tong during operation. The pipe is grippingly engaged by the moment arm/inner/frame/die assembly. As the lead tong rotates the upper piece of pipe, clockwise in this example, a clockwise torque, $T_D$, is applied to the lower pipe. Consequently torque $T_D$ is also applied to the moment arm/inner frame/die assembly grippingly engaged with the lower pipe. Torque $T_D$ tends to produce angular rotation of the moment arm-/inner frame/die assembly, but said rotation is resisted by the load cell. In turn load cell movement is resisted by the plate affixed to the external housing. The forces generated by the load cell resisting angular rotation of the moment arm/inner frame/die assembly, $F_{x1}$ and $F_{x2}$, are transferred through the moment arm/inner frame/die assembly and the external housing and give rise to forces $F_{x3}$ and $F_{x4}$ of equal magnitude, but opposite direction, at the radial bearing (or a such other pivot point which may have been chosen). $F_{x1}$ and $F_{x3}$ constitute a "couple" (paired forces of equal magnitude but opposite direction) as doe $F_{x2}$ and $F_{x4}$, hence the net effect of all forces is two opposing pure torque forces, without any net linear forces vectors which would impose a lateral or bending force on the pipe.

Referring now to FIGS. 11 through 16 there are illustrated alternate preferred embodiments of the present invention. These embodiments provide a new torque isolating structure which permits certain modifications to the housing and configuration of the previously described embodiment, while maintaining the feature of isolating the torque transfer forces from the driving to the back-up tongs, while eliminating any other lateral or linear forces in the x, y or z directions, and the below described embodiment provides more accurate torque readings.

Although the previously described embodiment did permit freedom of movement through the provision of the z-slide, x-slide, and y-slide mechanisms, the physical structural requirements for a framework permitting use of the slides while connecting the lead and back-up tongs in a manner to transmit torque were such that the resulting framework was massive and cumbersome to use. The second embodiment of the present invention maintains the torque isolating features of the first embodiment in a much smaller, more refined package, that also eliminates additional interference with the torque readings.

Figure 11:
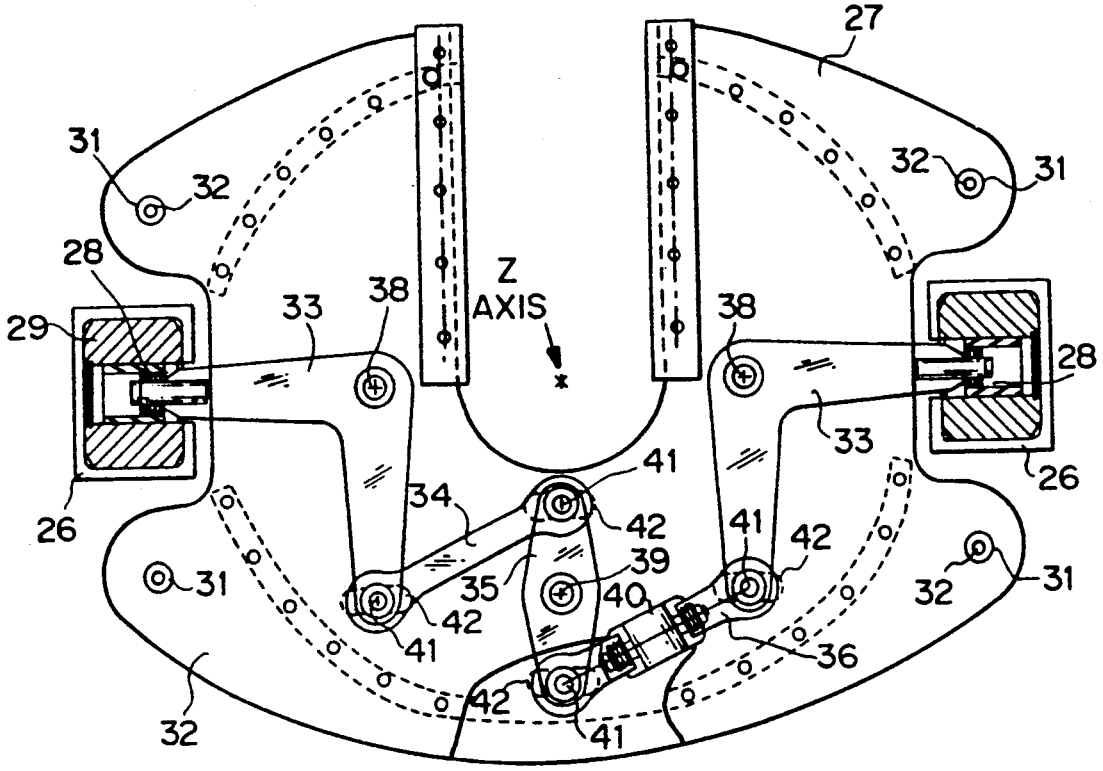
FIG. 11 is a plan view of a section through the lower tong of the second embodiment of the invention illustrating the torque isolating interconnections between the tongs.
Figure 14:
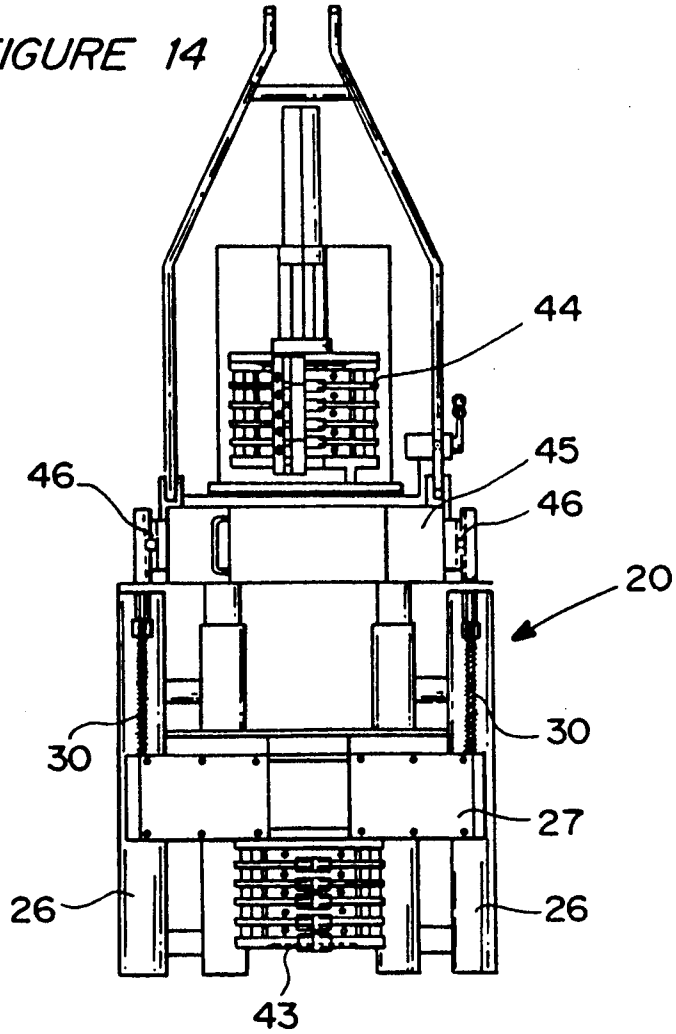
FIG. 14 is a front elevational view of the apparatus of FIG. 13.
Figure 13:
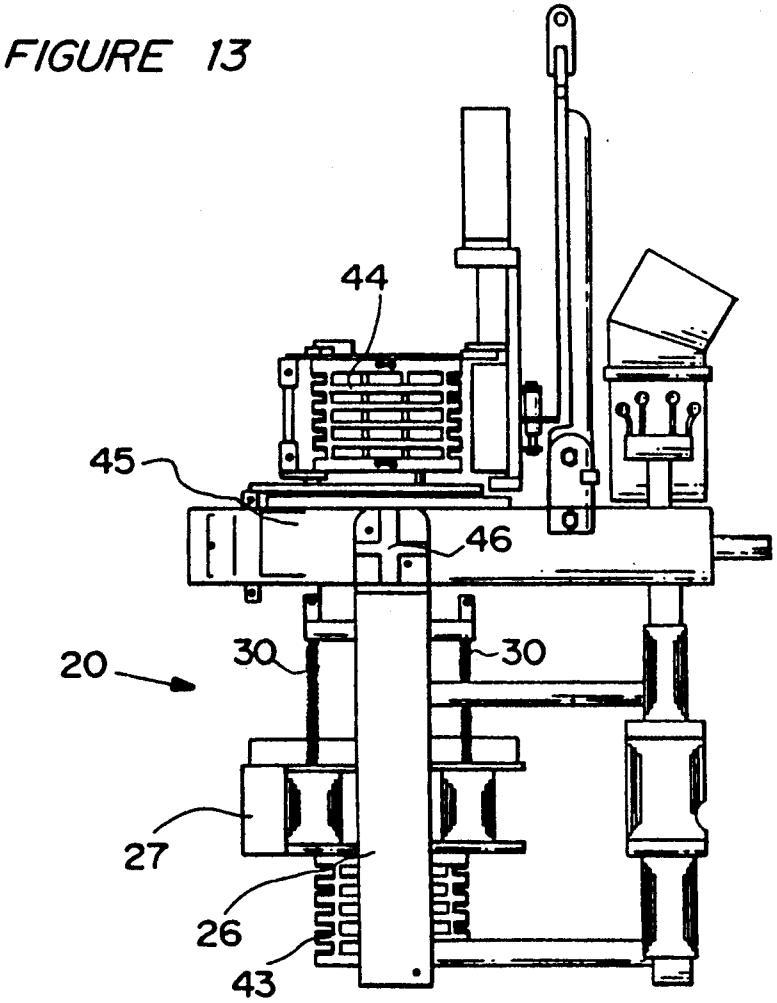
FIG. 13 is a side elevation view of a complete assembled lead and torque isolating back-up tong apparatus.
Figure 15:
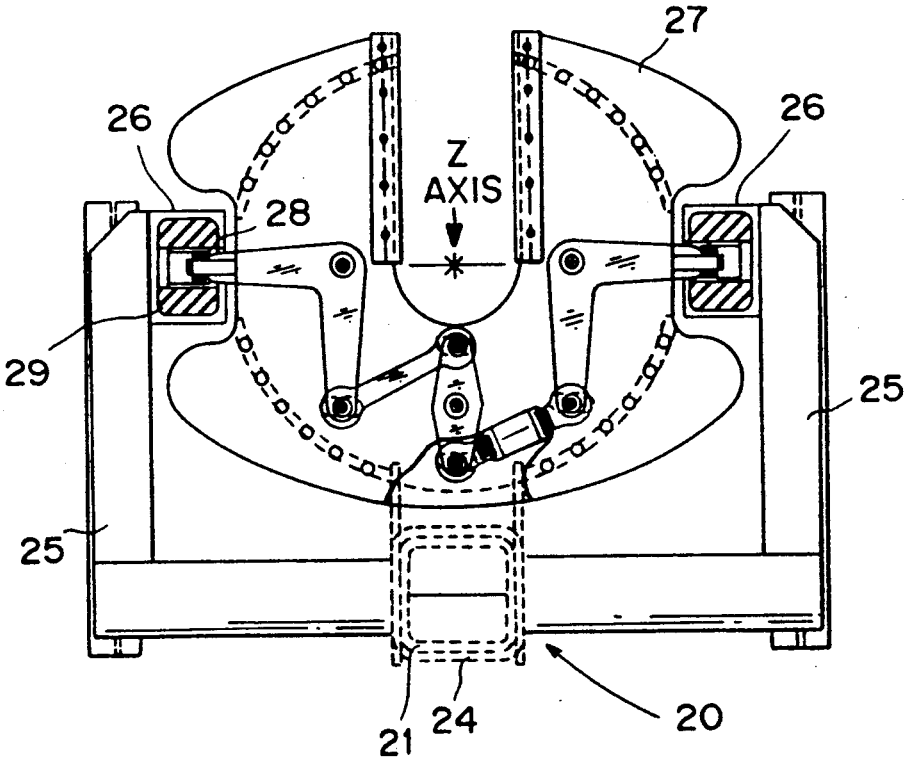
FIG. 15 is a plan view of the x, y, and z freedom connections of the second embodiment of the present invention, and the torque transfer tube.

Illustrated in FIGS. 13 through 16 are two different configurations are two different configurations for a torque transfer framework 20 made possible by the new and improved isolation mechanism for the back-up tong which is best illustrated in FIGS. 11 and 15. FIGS. 13 and 14 illustrate in side and frontal elevational views respectively an entire lead and back-up tong apparatus which utilizes two torque transfer legs 26 oppositely mounted on either side of the lower gripping apparatus 43. Members 26 in the embodiment illustrated in FIGS. 13 and 14 are channel shaped members which are securely attached to the upper tong housing 45 at connection 46. The torque isolating means will be discussed in further detail below, but as illustrated in FIGS. 13 and 14 when a cylindrical body (not shown) is secured by the lower gripping element 43, and subjected to torque by the upper gripping element 44 although the isolation housing 27 is free to "float", and is allowed a degree of lateral and vertical freedom relative to the upper housing 45, any pure torque will be resisted by members 26 through their connection at 46 to the upper housing 45.

Figure 16:
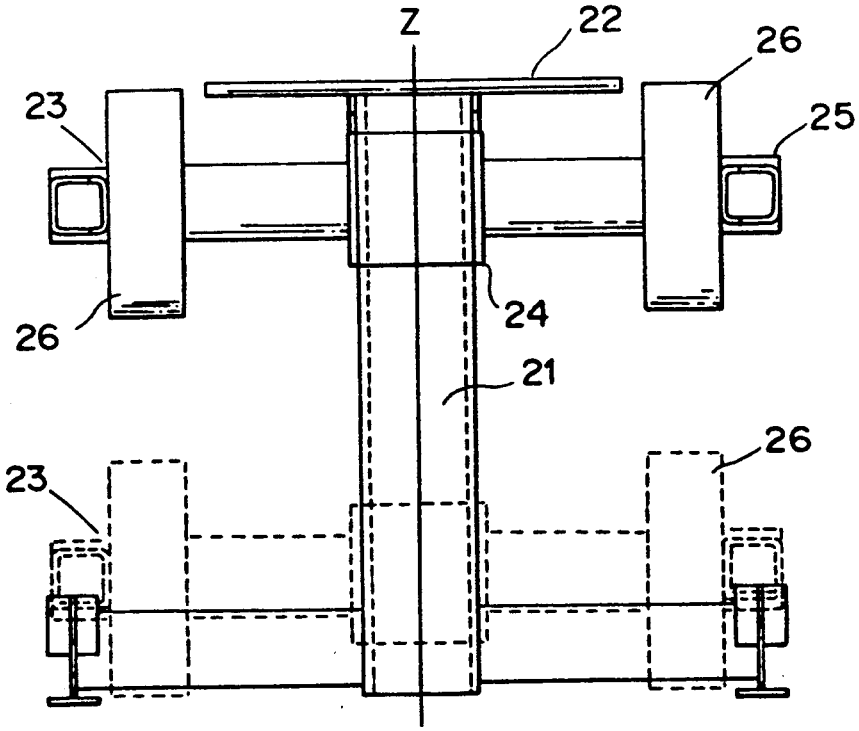
FIG. 16 is an elevational view of the torque transfer means between the paired tongs of the second embodiment of the present invention.

Referring to FIGS. 15 and 16, in FIG. 15 there are illustrated portions of the torque transfer framework 20 and a sectional view through tongs equipped with an alternative embodiment of the present invention. FIG. 16 illustrates a frontal elevational view of the torque transfer framework wherein 21 is the main torque transfer tube, 22 is the mounting plate for the lead tong (not shown), and wherein 23 is a mounting frame for the back-up tong. FIGS. 15 through 16 illustrate an alternative torque transfer framework to that illustrated in FIGS. 13 and 14 wherein members 26 are not connected directly to the upper tong housing 45, but rather where members 26 are instead utilized with a torque transfer framework 20 connecting them to a central torque transfer tube 21 by vertical sliding connection 24.

23 is also shown in dashed view at the lower portion of FIG. 16 to illustrate that the entire framework 23 is free to move on the z axis which is illustrated in FIG. 15 as concentric with the longitudinal axis of cylindrical members which are to be connected by the tongs. The torque transfer apparatus 23 as illustrated in FIGS. 15 through 16 for the lower tong comprises a slidable connection 24 adapted to slide about the main torque transfer tube 21, and a torque transfer framework 25 which positions members 26 which are channel shaped members in the illustrated embodiment at opposite sides of the back-up tong movement and torque isolation housing 27.

Figure 12:
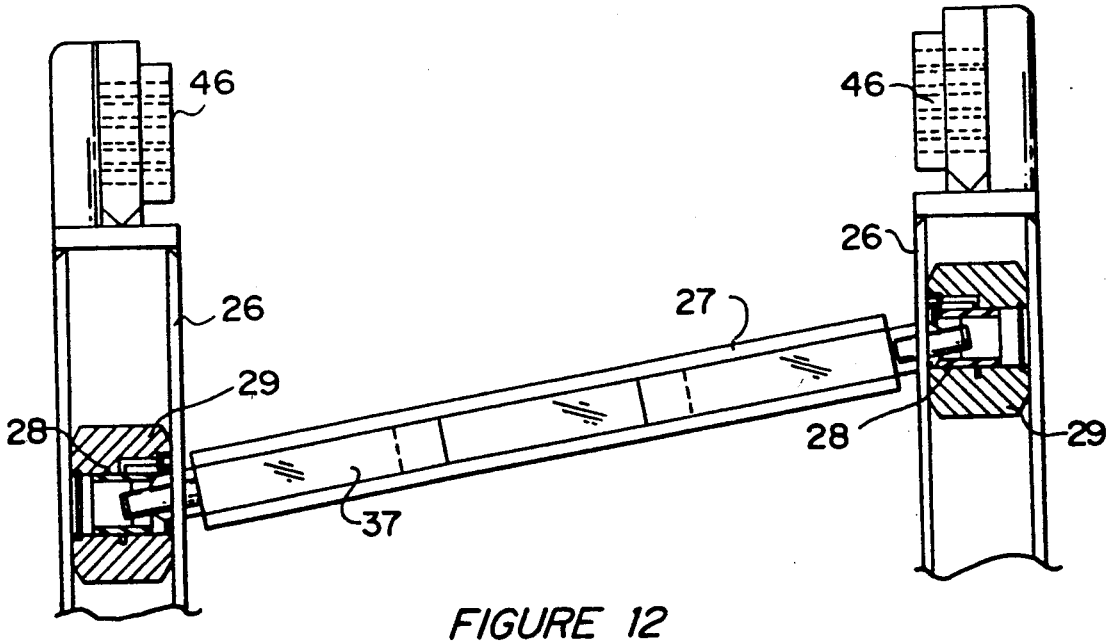
FIG. 12 is an elevation of a portion of the second embodiment of the invention illustrating the z freedom connections.

In general, the embodiment illustrated in FIGS. 13 and 14 is preferred as it provides a more compact overall apparatus, the other embodiment of FIGS. 15 through 16 is given for illustrative purposes. The lower tong torque isolation housing 27 and other internal components utilized therewith, and the connection of the isolation housing to the torque transfer frameworks are the same, and the following discussion could apply equally to either variant. Components (to be described below) fixed within the isolation housing 27 are connected by a pivoting connection 28 to roller bearings 29, which reside in channel members 26 and thus permit both pivoting movement of the housing 27 relative to the channels 26, and a suspension means allowing linear movement of the roller bearings 29 and housing 27 in the z direction. The roller bearings 29 with their pivoting connections 28 to the isolation housing 27 thus permit movement of the housing 27 up and down along the longitudinal z axis as the rollers roll up and down in channels 26. The roller bearings 29 are components comprising part of a means allowing lateral slipping, they are configured to also permit movement of connections 28 and thus housing 27 to a limited degree in and out along the axis of the axle of the roller bearing, this translates to a limited degree of side to side movement of the housing 27, and also allows a limited degree of inclination of the housing 27 laterally, that is one roller bearing could be relatively to the upper tong housing at its connection to the channel members 46 as is illustrated in FIG. 12.

A weight supporting connection is made between the overall framework 20 and the housing 27 by means of cables 30 which are secured to some portion of either the torque transfer framework or the mounting plate 22 for the lead tong or to the lead tong as best illustrated in FIGS. 11 through 14. The cables 30 run through openings 31 provided at points on the housing 27 and are connected in the preferred enabling embodiment by means of a spring connection 32 to the housing 27, to permit the housing 27 to "float" relative to the mounting plate 22 (and thus relative to the lead tong).

The back-up tong mounting housing 27 is connected in the embodiment illustrated in FIGS. 11 and 16 to the torque transfer framework 25 by a pivoting linkage arm arrangement. As previously described, the housing is mounted within channels 26 (which are connected to the framework 25 or upper tong housing 45) by means of roller bearings 29. Referring to FIGS. 11 and 15, in addition to the roller bearings 29 the components of the lateral slipping means further comprise a pivoting connection which attaches linkage arms 33 at their outer ends to the roller bearings 29. The linkage arms 33, connecting link 34, pivot link 35, and combination connecting/torque reading link 36 are lateral slip components mounted within a space 37 provided within housing 27 as illustrated in FIG. 12. This space can be fashioned by using flat plates for upper and lower surfaces to form the housing 27, and spacing the upper and lower plates a distance apart to form the space 37.

As will be more fully described below, the illustrated components of the present invention will operate so that pivot arms and pivot link and transfer links to the back up tong housing, and their pivoting roller connections to torque transfer frame work, cooperate so that back to front lateral freedom is allowed by the pivoting of the pivot arms and pivotal link, and side to side movement is allowed by the slip connections of the pivot arms to the roller bearings.

The arms 33 are pivotally mounted by pivot connections 38 through the housing 27. These pivoting connection's 38 prevent any movement other than a pivoting of the arm 33 in one plane about the connection points 38. Similarly, pivot link 35 is pivotally mounted at 39. The pivot arms 33, and pivot link 35 are interconnected by transfer link 34 and the combination transfer/torque reading link 36. The torque reading is accomplished by means of a load cell 40 which may be threadedly attached as an intermediate component part of link 36 so as to read torque in both tension and compression.

The linkage connections 41 interconnect arms 33, pivot link 35, and the transfer links 34 and 36, these pivot connections 41 are not secured to the frame 27, and in fact are positioned within openings 42 within the housing, so as to cooperate therefore with the suspension means 30, 31, 32 and pivot roller bearing connection means 28, 29, 26 to permit a limited degree of freedom of linear movement of the housing 27 and thus the jaws of the back-up tong relative to the lead tong, in the x, y and z directions while maintaining a complete transfer of any pure torque applied between lead and back-up tongs. The lateral slip thus is allowed side to side by the roller bearing and channel configuration, and front to back by the linkage arm arrangement, and up and down due to the roller bearing, channels, and cable and spring components, and thus the tolerances permitted in the x, y and z directions are sufficient to accommodate any minor mis-alignments, and the floating freedom of movement is sufficient to prevent any undesirable lateral loading, but any pure torque is directly transferred and measurement of that torque is accurately read by the load cell incorporated in one of the connecting links.

Another embodiment of the improved back-up tongs, not shown, would be to eliminate the radial bearing but provide another point (not coincident with the pipe axis), through which the outer housing and inner frame would pivotally interact.

Another embodiment of the present invention (not shown) would be to use an ordinary lead tong and ordinary back-up tong and obtain a torque measurement by indirect means such as measuring hydraulic pressure acting on the lead tong motor.

Another embodiment of the present invention (not shown) would be an ordinary back up tong, but an improved lead tong to produce a torque measurement. Said improved lead tongs would be similar to the back-up tongs described fully herein, that is, the lead tong would have an outer housing pivotally engaged with an inner frame at or near a point coincident with the pipe axis, the gripping and rotating elements, as well as a moment arm, being disposed on the inner frame, which moment arm would cooperate with the outer housing, through a load cell, to produce a torque measurement.

Many other embodiments of the present invention are possible, without departing from the spirit and intent of the invention.

What is claimed:

1. An apparatus for applying torque to a first longitudinal member about said member's longitudinal axis relative to a second longitudinal member, said members remaining free from any reactant lateral forces responsive to said torque, said apparatus comprising:

(a) first and second gripping and aligning means for securing said first and second members in substantial coaxial alignment along a longitudinal axis;

(b) means for applying a rotational force to impart rotational movement to said first gripping and aligning means;

(c) connection means comprising torque transfer means fixing rotationally stationary said second gripping and aligning means relative to rotation of said first gripping and alignment means; and, (d) first second and third assembly means permitting independent triaxial and angular movement of said second gripping and alignment means relative to said first gripping and alignment means, wherein:

(i) said first assembly means comprises suspension means allowing longitudinal movement of said second gripping and aligning means relative to said first gripping and aligning means; and, (ii) said second and third assembly means comprise first and second lateral slip means allowing lateral movement of said second gripping and aligning means relative to said first gripping and alignment means.

2. The invention of claim 1 wherein said first gripping and aligning means and said means for rotating said first gripping and aligning means comprises a power driven lead tong and wherein said second gripping and aligning means comprises a backup tong.

3. The invention of claim 1 wherein said connection means comprises a torque transfer frame comprising:

(a) a lead tong housing to which said first gripping and aligning means is connected, a backup tong housing to which said second gripping and aligning means is connected, and two elongate torque transfer leg members oppositely mounted across the longitudinal alignment axis and secure to the lead tong housing and extending downward in substantially parallel form relative to said first and second members;

(b) a connection member slidably secured to eac of said torque transfer leg members so that each connection can move longitudinally along said leg members wherein said slidable connections are connected by pivoting connections to said first lateral slipping means within said slidable connections wherein said first lateral slipping means is further connected through said pivoting connections to said second lateral slip means which is secured to said backup tong housing.

4. The invention of claim 3 wherein said suspension means comprises at least one cable secured to said lead tong housing at one end and secured by spring means to said backup tong housing at its second end.

5. The invention of claim 4 wherein said second lateral slipping means comprises two pivot arms and a pivot link and two transfer links wherein said pivot arms and pivot link are connected to said backup tong housing and wherein each transfer link links one end of a pivot am to one end of said pivot link and wherein said second lateral slipping means comprises slip connections at the connection of each pivot arm to said slidable connection secured to each torque transfer leg member so that front to back lateral freedom is allowed by the pivoting of the pivot arms and pivot link, and side to side movement is allowed by the slip means at the connection of the pivot arms to said slidable connection to said torque transfer leg members.

6. Invention of claim 5 wherein one of said transfer links incorporates load cell means which gives a reading of the torque imparted by said rotation of said first gripping and aligning means which is transferred by said torque transfer means and resisted by said second gripping and aligning means.

* * * * *